United States Patent [19]

Suzuki et al.

[11] Patent Number: 4,468,670

[45] Date of Patent: Aug. 28, 1984

[54] ANTENNA DEVICE FOR AIR TRAFFIC RADAR

[75] Inventors: Yasuo Suzuki, Tokyo; Taneaki Chiba, Yokohama, both of Japan

[73] Assignee: Tokyo Shibaura Denki Kabushiki Kaisha, Kawasaki, Japan

[21] Appl. No.: 341,585

[22] Filed: Jan. 21, 1982

[30] Foreign Application Priority Data

Jan. 29, 1981 [JP] Japan ..... 56-12096

[51] Int. Cl.[3] ..... H01Q 19/12; H01Q 25/00

[52] U.S. Cl. ..... 343/727; 343/779

[58] Field of Search ..... 343/776, 779, 727, 730, 343/786

[56] References Cited

U.S. PATENT DOCUMENTS

| | | | |
|---|---|---|---|
| 3,460,144 | 8/1969 | Hannan | 343/779 |
| 3,495,262 | 2/1970 | Paine | 343/776 |
| 3,683,374 | 8/1972 | Honold | 343/372 |
| 3,798,646 | 3/1974 | Buehler et al. | 343/779 |
| 3,997,897 | 12/1976 | Brunner et al. | 343/6 R |
| 4,207,573 | 6/1980 | Vignier | 343/779 |
| 4,284,991 | 8/1981 | Dupressoir | 343/725 |

FOREIGN PATENT DOCUMENTS

| | | |
|---|---|---|
| 0025739 | 3/1981 | European Pat. Off. . |
| 2411158 | 3/1974 | Fed. Rep. of Germany . |

*Primary Examiner*—Eli Lieberman

*Attorney, Agent, or Firm*—Finnegan, Henderson, Farabow, Garrett & Dunner

[57] ABSTRACT

Disclosed is an antenna device, which comprises a reflector and a primary radiator for an ARSR system including a low beam horn antenna disposed at a position substantially at the focal point of the reflector and a high beam horn antenna disposed below the low beam horn antenna. The antenna device further comprises a primary radiator for an SSR system including two modified diagonal horns provided on opposite sides of and having outside perimeters complementary to the arrangement of the low and high beam horn antennas and at positions corresponding to a position midway between the low and high beam horn antennas. A Yagi antenna used as a part of the SSR radiator, is disposed above the low beam horn antenna. Thus, the antenna device can be used commonly for both the ARSR and SSR systems.

13 Claims, 8 Drawing Figures

ANTENNA DEVICE FOR AIR TRAFFIC RADAR

BACKGROUND OF THE INVENTION

This invention relates to an antenna device used for air traffic radar.

There are two kinds of air traffic control radars. One kind is a primary surveillance radar (PSR) making use of signals reflected from an airplane for locating it. Examples of this type of radar are an airport surveillance radar (ASR) or an air route surveillance radar (ARSR). Another kind of traffic control radar is a secondary surveillance radar (SSR). An SSR utilizes a response signal which may include airplane identification information transmitted from an airplane's transponder.

Both these radar systems are often used together, and their antennas are used in combination. For example, the ARSR system, the function of which is to suppress clutter and which uses a dual beam type reflector antenna radiating both low and high beams, and the SSR antenna, which radiates a beam of a narrow width in the horizontal plane and uses an array antenna, are installed together, the SSR antenna being mounted on top of the reflector of the ARSR antenna.

However, there has recently been a need to use an antenna having a vertical plane radiation pattern having sharp cut-off characteristic even in the SSR system in order to avoid lobing due to clutter. Therefore, it is sometimes necessary to use a reflector antenna having a large aperture like the SSR antenna. In such a case it is difficult to install the SSR antenna on top of the reflector of the ARSR antenna.

The reflector of the ARSR antenna is constructed to provide for a vertical plane radiation pattern having a sharp cut-off characteristic at approximately 1.3 GHz. Therefore, if the SSR system covers a band of 1.03 to 1.09 GHz, for instance, the reflector of an ARSR antenna can be commonly used for both the ARSR and SSR radar systems. To this end, the primary radiator of the SSR system may be installed in the neighborhood of the primary radiator of the ARSR system. However, the primary radiator of the dual beam system ARSR antenna includes a high beam horn disposed below the low beam horn. There are the problems associated with how and where the SSR primary radiator is located in relation to these high and low beam horns.

Where a single SSR primary radiator is arranged adjacent to the low beam horn, it is defocused in the Azimuth plane, and therefore beam shift or beam skew occurs in the horizontal plane radiation pattern of the SSR antenna. This causes a shift of the beam nose in the horizontal plane radiation patterns of the SSR and ARSR antennas and makes the mono-pulse angle measurement impossible. By using two horns arranged, for example, in an Azimuth plane, a mono-pulse angle measurement is carried out by obtaining sum and difference signals on the output of the respective horns. In this case, it is required that sum and difference patterns be symmetrical with respect to the antenna axis on the azimuth plane. Where two SSR primary radiators are disposed on opposite sides of the low beam horn, the low beam horn being large in size, the SSR primary radiators are spaced too far apart, giving rise to a beam split in the SSR system antenna in the horizontal plane radiation pattern and making the mono-pulse angle measurement impossible. This arrangement is not suitable for the SSR antenna.

SUMMARY OF THE INVENTION

An object of the invention is to provide an antenna device which can be commonly used for a plurality of radar systems without the possibility of beam shift, beam skew or beam split in the horizontal plane radiation pattern and also without the possibility of deviation of beam nose in the vertical plane radiation pattern.

This object is attained by an antenna device comprising a reflector, a first primary radiator including a low beam antenna disposed in the neighborhood of the focal point of the reflector and a high beam antenna, and a second primary radiator including a first antenna disposed midway between the low and high beam antennas and a second antenna disposed on the side of the low beam antenna opposite the high beam antenna.

DETAILED DESCRIPTION OF THE PREFERRED EMBODIMENTS

Figure 1:
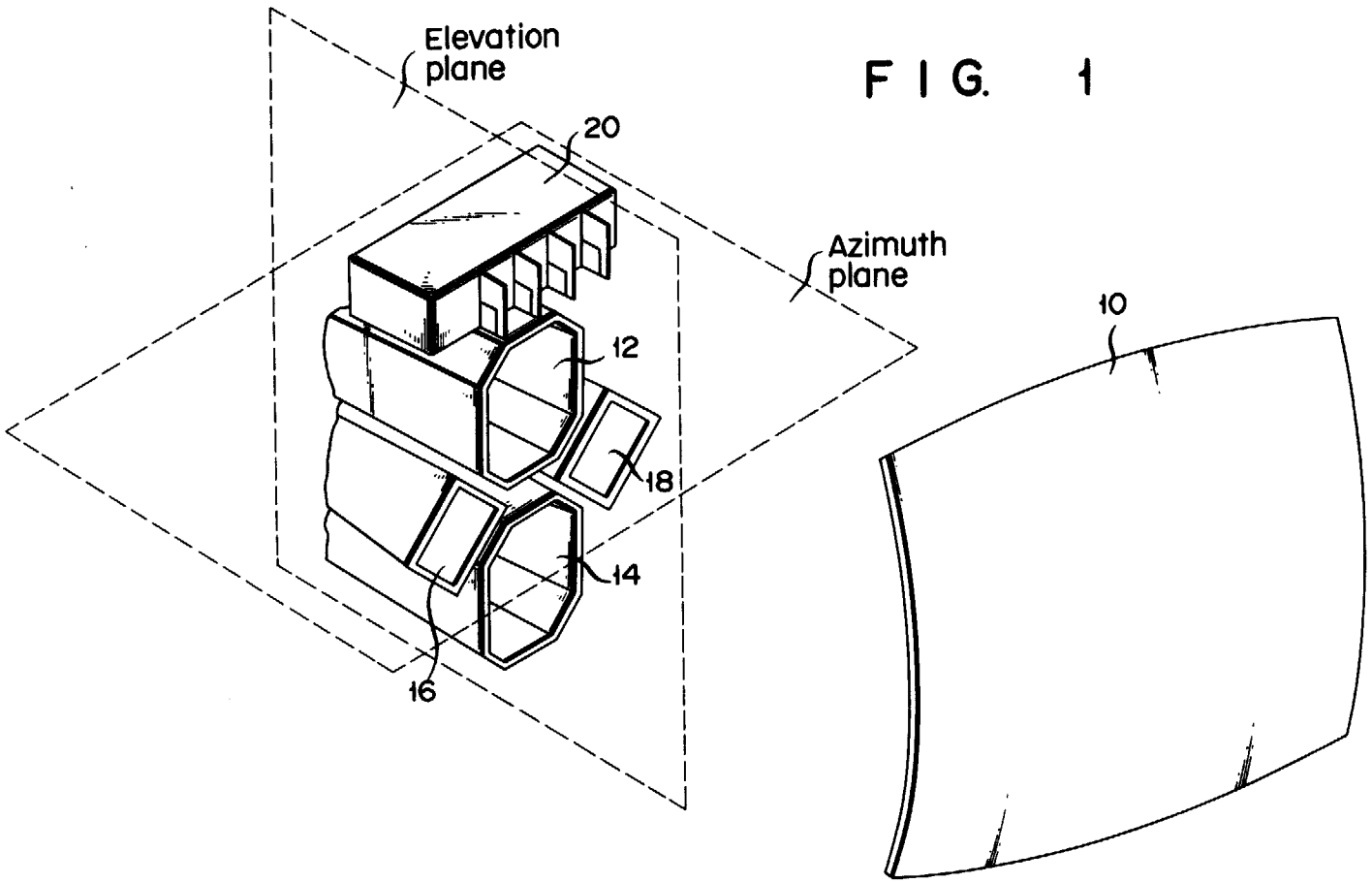
FIG. 1 is a schematic view showing an embodiment of the antenna device according to the invention.

Now, preferred embodiments of the antenna device according to the invention will be described with reference to the drawings. FIG. 1 is a schematic perspective view of an embodiment of the invention. A low beam horn 12, which constitutes part of a primary radiator of an ARSR system, is disposed in the neighborhood of the focal point of a reflector 10 such that its aperture faces the mirror surface of the reflector 10. Since the electromagnetic wave of the ARSR is a circularly polarized wave, the E and H plane radiation patterns of the primary radiator 12 should be identical. Accordingly, the shape of the aperture of the low beam horn 12 is substantially octagonal.

A high beam horn 14, which is also an octagonal horn and constitutes an ARSR antenna, is disposed below the low beam horn 12. Modified diagonal horns 16 and 18, which constitute part of primary radiator of an SSR antenna, are disposed on opposite sides of the arrangement of the low and high beam horns 12 and 14 and at positions corresponding to a position midway between these horns 12 and 14. The apertures of these horns 16 and 18 lie in the same plane as the apertures of the low ad high beam horns 12 and 14. The SSR antenna primary radiator also includes a Yagi antenna 20 which is disposed above the low beam horn 12.

The radiation pattern of the embodiment having the above construction will now be described. As mentioned previously, the apertures of the low and high beam horns 12 and 14 are octagonal. Thus, by making the outer shape of the modified diagonal horns 16 and 18 complementary to the outer shape of the portions of the arrangement of the low and high beam horns 12 and 14, the distance between the two modified diagonal horns 16 and 18 in the Azimuth plane can be reduced. With this arrangement, the horizontal plane radiation pattern of the SSR antenna is free from beam split and has strong directivity as shown in FIG. 2.

Figure 2:
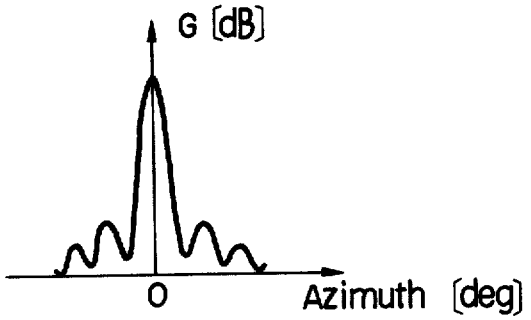
FIG. 2 is a graph showing the horizontal plane radiation pattern of the SSR antenna of the embodiment.

In FIG. 2, the ordinate is taken for the relative gain G (dB), and the abscissa is taken for the Azimuth (deg). Thus, it is possible to make the SSR mono-pulse angle measurement without any trouble even where the SSR primary radiator is provided as separate radiators on opposite sides of the ARSR primary radiator.

Figure 3:
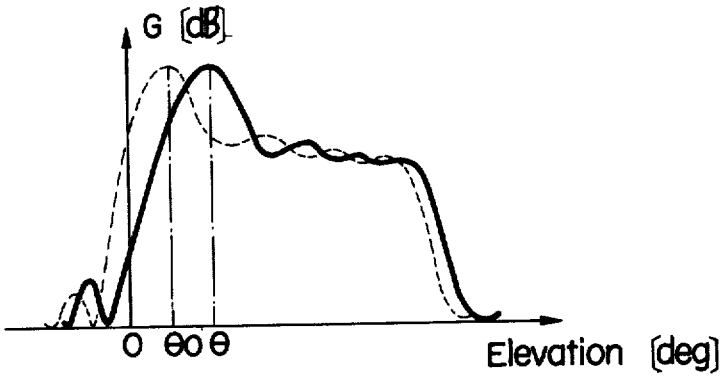
FIGS. 3 and 4 are graphs showing vertical plane radiation patterns of the SSR antenna of the embodiment.

Now, the vertical plane radiation pattern will be discussed. Since the focal point of the reflector 10 is contained in the ARSR low beam horn 12, the modified diagonal horns 16 and 18 of the SSR antenna are found below the focal point of the reflector 10 in the Elevation plane. Thus, the vertical plane radiation pattern of electromagnetic radiation from the modified diagonal horns 16 and 18 (without Yagi antenna 20) is as shown by the solid curve in FIG. 3, in which the vertical plane radiation pattern of the low beam horn 12 is as shown by the dashed curve. This means that the Elevation $\theta$ of the electromagnetic radiation beam nose of the modified diagonal horns 16 and 18 is larger than the Elevation $\theta_0$ of the beam nose of the low beam horn 12. However, in this embodiment the SSR antenna primary radiator includes the Yagi antenna 20 provided above the low beam horn 12 in addition to the modified diagonal horns 16 and 18.

Figure 4:
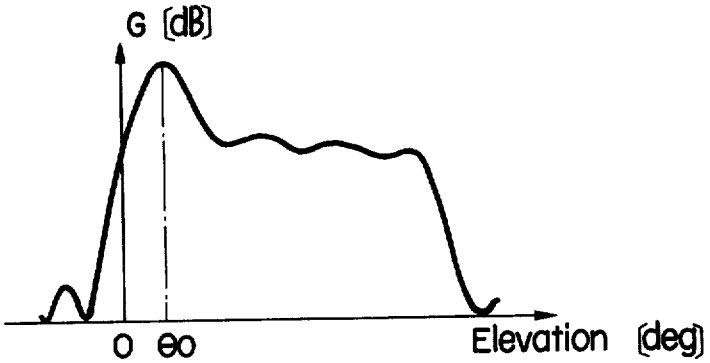

The Elevation of the beam nose of the Yagi angenna is set to a value smaller than that of the low beam horn 12. Thus, for the SSR antenna, the vertical plane radiation pattern may be given a desired sharp cut-off characteristic as shown in FIG. 4. In addition the beam nose position may be made to coincide with that for the low beam horn 12 by combining the radiation beams of the modified diagonal horns 16 and 18 and Yagi antenna 20 in appropriate proportions such that the equivalent phase center of the SSR antenna coincides with that of the low beam antenna 12. By so doing, the lobing phenomenon in the ARSR system also can be virtually eliminated.

As has been shown, according to the embodiment it is possible to provide an antenna deivce which is free from beam split or beam nose non-coincidence and can be commonly used for both the ARSR and SSR systems.

Other embodiments of the invention will be described hereinafter. These embodiments concern modifications of the primary radiators.

Figure 5:
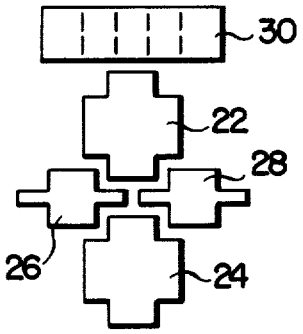
FIGS. 5 to 8 are sectional views showing primary radiators in other embodiments of the invention.

FIG. 5 shows a second embodiment. Here, cross-shaped horns each having a cross-shaped aperture suitable for the circular polarization are used as the low and high beam horns 22 and 24 of the ARSR primary radiator. Also, cross-shaped horns 26 and 28 are used for the SSR primary radiator, and they are disposed on opposite sides of the arrangement of the low and high beam horns 22 and 24. The SSR primary radiator also includes a Yagi antenna 30 provided above the low beam horn 22 as in the preceding embodiment.

With this second embodiment, using the cross-shaped horns, the SSR primary radiators may be disposed close to each other in the Azimuth plane. Thus, it is possible to eliminate beam split in the horizontal plane radiation pattern of the SSR antenna.

Figure 6:
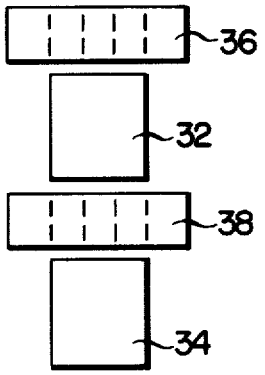

FIG. 6 shows a third embodiment. Here, low and high beam horns 32 and 34 each having substantially a rectangular aperture are used for the ARSR primary radiator. Also, the Yagi antennas 36 and 38 are used as SSR primary radiator, and they are disposed above and below the low beam horn 32 respectively.

Since only one Yagi antenna 38 of the SSR primary radiator is provided between the low and high beam horns 32 and 34, there is no problem of beam split in the horizontal plane radiation pattern of the SSR antenna.

Figure 7:
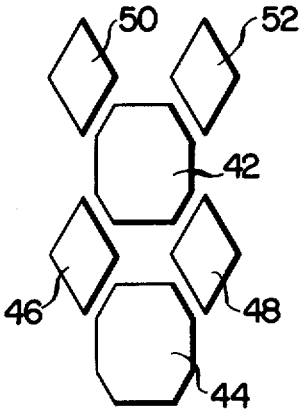

FIG. 7 shows a fourth embodiment. Substantially octagonal low and high beam horns 42 and 44, as in the embodiment of FIG. 1, are used to form the ARSR primary radiator, and the SSR primary radiator includes modified diagonal horns 46 and 48 provided on opposite sides of and at positions midway between the horns 42 and 44. The difference with this embodiment from the first embodiment is that modified diagonal horns 50 and 52 are provided as part of the SSR primary radiator above the low beam horn 42.

Figure 8:
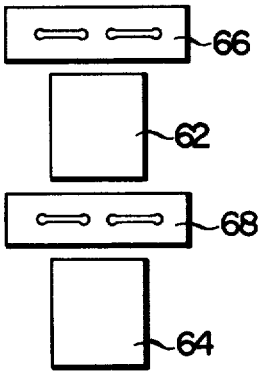

FIG. 8 shows a fifth embodiment. Here, as with the third embodiment, low and high beam horns 62 and 64 each having substantially a rectangular aperture are used for the ARSR primary radiator. Slit antennas 66 and 68 are used as the SSR primary radiator, and they are disposed above and below the low beam horn 32 respectively.

The above embodiments of the invention are by no means limitative, and various changes and modifications are possible. For example, the primary radiator of either radar antenna may have various shapes so long as the component radiators of the SSR primary radiator can be disposed close to each other in the Azimuth plane. Further, while the above description has concerned with antennas which can be used commonly for the ARSR and SSR systems, the invention is also applicable to antennas which can be used commonly for different systems with respective frequency coverages close to one another.

As has been described in the foregoing, according to the invention two SSR antenna primary radiators are disposed close to each other in a horizontal plane so that the horizontal radiation pattern of the SSR antenna is improved. Also, a beam from a primary radiator provided at a separate position in the Elevation plane is used in synthesizing the radiation beam to improve the vertical plane radiation pattern of the SSR antenna. Thus, the ARSR and SSR antennas can use a common reflector.

What we claim is:

1. An antenna device comprising:

a reflector;

a first primary radiator including a low beam antenna disposed substantially at the focal point of said reflector and a high beam antenna adjacent one side of said low beam antenna; and a second primary radiator including a first antenna in the azimuth plane between said low and high beam antennas, at least a part of said first antenna being in a region between elevation planes each contacting a different opposing side of said high and low beam antennas, and a second antenna disposed on the side of said low beam antenna opposite said high beam antenna and arranged so that the equivalent phase center of said second primary radiator substantially coincides with that of said low beam antenna.

2. An antenna device for use with an air traffic control radar according to claim 1, wherein said first primary radiator includes a low beam horn antenna disposed to contain the focal point of said reflector and a high beam horn antenna disposed below said low beam horn antenna in the Elevation plane, and also wherein said second antenna is disposed above said low beam horn antenna in the Elevation plane.

3. An antenna device according to claim 2, wherein said low and high beam antennas include octagonal horns each having an octagonal aperture, said first antenna includes two modified diagonal horn antennas provided on opposite sides of the arrangement of the low and high beam horn antennas and at positions corresponding to a position midway between said low and high beam horn antennas, and said second antenna includes a Yagi antenna.

4. An antenna device according to claim 2, wherein said low and high beam horn antennas are respectively cross-shaped horns each having a substantially cross-shaped aperture, said first antenna includes two cross-shaped horns each having a substantially cross-shaped aperture and disposed on opposite sides of and complementary to a position midway between said low and high beam horn antennas, and said second antenna is constituted by a Yagi antenna.

5. An antenna device according to claim 2, wherein said low and high beam horn antenna are respectively rectangular horns each having a substantial rectangular aperture, and said first and second antennas are respective Yagi antennas.

6. An antenna device according to claim 2, wherein said low and high beam horn antennas are respective octagonal horns each having a substantial octagonal aperture, said first antenna includes two modified diagonal horns disposed on opposite sides of the arrangement of said low and high beam horn antennas at positions corresponding to a position midway between said low and high beam horn antennas, and said second antenna includes two modified diagonal horn antennas disposed above and on opposite sides of said low beam horn antenna.

7. An antenna device according to claim 2, wherein said low and high beam horn antennas are respectively rectangular horns each having a substantial rectangular aperture, and said first and second antennas are respective slit antennas.

8. An antenna device according to claim 1 wherein each of said first and second antennas are arranged symmetrically about an axis passing through the center of said low beam antenna and said high beam antenna.

9. An antenna device according to claim 8, wherein said low and high beam antennas include octagonal horns each having an octagonal aperture, said second primary radiator includes two modified diagonal horn antennas provided on opposite sides of the arrangement of the low and high beam horn antennas and at positions corresponding to a position midway between said low and high beam horn antennas.

10. An antenna device according to claim 8, wherein said low and high beam antennas are respectively cross-shaped horns each having a substantially cross-shaped aperture, said second primary radiator includes two cross-shaped horns each having a substantially cross-shaped aperture and disposed on opposite sides of and complementary to a position midway between said low and high beam antennas.

11. An antenna device according to claim 8, wherein said low and high beam antennas are respectively rectangular horns each having a substantial rectangular aperture, and said second primary radiator includes a Yagi antenna.

12. An antenna device according to claim 8, wherein said low and high beam antennas are respective octagonal horns each having a substantial octagonal aperture, said second primary radiator includes two modified diagonal horns disposed on opposite sides of the arrangement of said low and high beam antennas at positions corresponding to a position midway between said low and high beam antennas.

13. An antenna device according to claim 8, wherein said low and high beam antennas are respectively rectangular horns each having a substantial rectangular aperture, and said second primary raiator includes a slit antenna.

* * * * *